US005158220A

United States Patent [19]

Glass

[11] Patent Number: 5,158,220

[45] Date of Patent: Oct. 27, 1992

[54] CASINO CUP/SLIPPER/SHOE HOLDER

[76] Inventor: Marne A. Glass, 9210 Whitney Way, Cypress, Calif. 90630

[21] Appl. No.: 712,150

[22] Filed: Jun. 6, 1991

Related U.S. Application Data

[63] Continuation-in-part of Ser. No. 509,218, Apr. 16, 1990, abandoned.

[51] Int. Cl.[5] ..... A45F 3/04

[52] U.S. Cl. ..... 224/209; 224/235; 383/40; 383/76

[58] Field of Search ..... 224/148, 202, 209, 235; 383/4, 38, 40, 75, 76

[56] References Cited

U.S. PATENT DOCUMENTS

| | | | |
|---|---|---|---|
| 481,116 | 8/1892 | Milligan | 383/40 X |
| 2,540,165 | 2/1951 | Fiel | 383/4 X |
| 2,580,796 | 1/1952 | Kleiss et al. | 383/76 X |
| 2,682,290 | 6/1954 | Ditlea | 383/4 X |
| 4,782,874 | 11/1988 | Chartier | 383/4 X |
| 4,974,761 | 12/1990 | Luque | 224/148 |

FOREIGN PATENT DOCUMENTS

| | | | |
|---|---|---|---|
| 61037 | 6/1939 | Norway | 383/40 |
| 111240 | 7/1967 | Norway | 383/38 |
| 2026852 | 2/1980 | United Kingdom | 383/40 |

*Primary Examiner*—Ernest G. Cusick
*Assistant Examiner*—Robert M. Fetsuga
*Attorney, Agent, or Firm*—Walter A. Hackler

[57] ABSTRACT

A casino coin cup, slipper and shoe holder including a foldable container having a closable open top, a closed bottom and a body for accepting and holding a plastic-type coin cup in a manner enabling access thereto through the closable open top. A drawstring is provided near the closable open top for releasably closing and said closable open top to accommodate different size cups, adjustable shoulder straps, attached to the foldable container body, are provided for carrying the foldable container; and at least one compartment of the foldable container is provided for storing at least one pair of footwear.

8 Claims, 2 Drawing Sheets

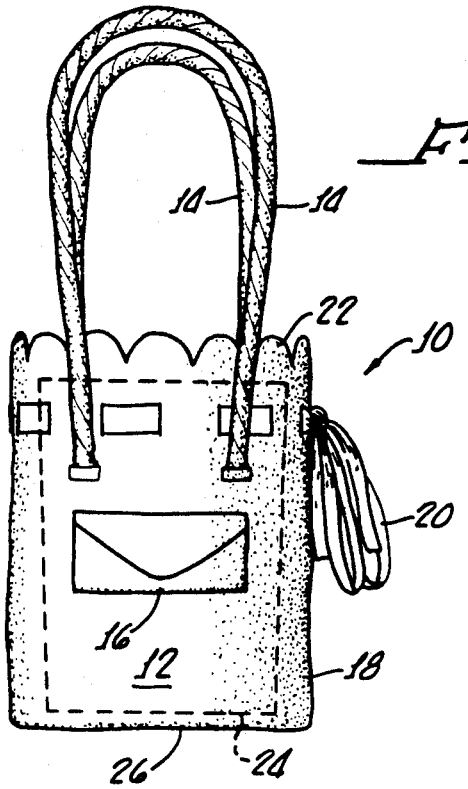
FIG. 1.
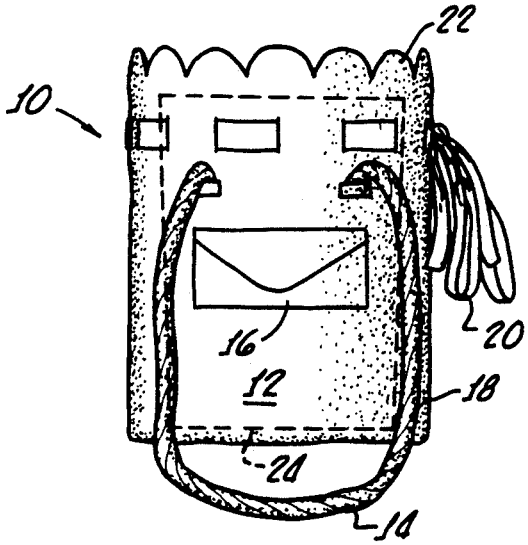
FIG. 3.
FIG. 2.
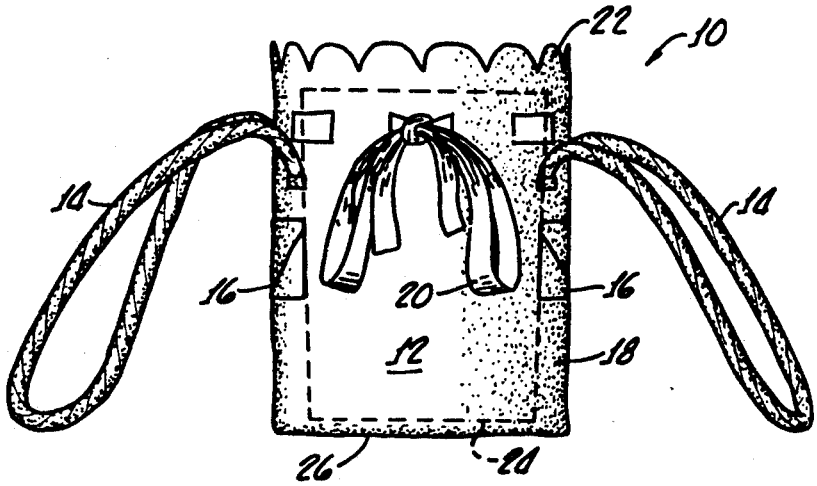

CASINO CUP/SLIPPER/SHOE HOLDER

This application is a continuation-in-part of U.S. patent application Ser. No. 07/509,218, filed Apr. 16, 1990, now abandoned.

BACKGROUND OF THE INVENTION

The present invention relates generally to handbags and more particularly to a hand-carried holder for simultaneously supporting a casino coin cup and storing at least one pair of footwear.

SUMMARY OF THE INVENTION

A casino cup, slipper and shoe holder in accordance with the purpose of the invention generally includes a foldable container having a closable open top, a closed bottom, and a body, which provides a means for accepting and holding various sizes of plastic-type coin cups in a manner enabling access thereto through the closable open top.

Used in a gambling establishment, the feature enables convenient access to coins for playing slot machines while providing privacy as to the number of coins in the possession of the user. Importantly, various size cups may be supported by the present invention, thus expanding its usefulness for both casino-provided cups and for personalized cups which may be of different diameters and heights.

Means are provided and disposed proximate the closable open top for securing different size cups in the foldable container and for closing said closable open top when no cup is used. Adjustable shoulder strap means are provided for carrying the foldable container and, in combination therewith, means are attached to the foldable container for storing at least one pair of footwear. This combination provides a specific advantage for enabling patrons of a casino to conveniently carry alternative pairs of footwear while participating in casino activities.

More particularly, a means for storing at least one pair of footwear is attached to the foldable container means closed bottom and depends therefrom. In one embodiment of the present invention, the means for storing at least one pair of footwear is configured for storing two pairs of footwear in a spaced apart relationship.

In this embodiment, a means for storing at lest one pair of footwear includes pocket means attached to the foldable container means closed bottom for storing a pair of foldable slippers. Attached thereto is a collapsible bag which provides means, when expanded, for carrying a pair of shoes.

Alternatively, side pocket means may be provided and attached to an exterior of the foldable container means body for storing cleaning accessories and, in order to accommodate the plastic coin cups, the foldable container means body may have a diameter of at most about six inches.

BRIEF DESCRIPTION OF THE DRAWINGS

The advantages and features of the present invention will appear from the following description, when considered in conjunction with the accompany drawings in which:

FIG. 1 is a side view of a foldable container in accordance with the present invention, along with a closable open top shown in an open position along with raised, adjustable shoulder straps, a side pocket along with a drawstring disposed proximate the closable open top;

FIG. 2 is a front view of the collapsible container shown in FIG. 1 with the shoulder straps in a down position;

FIG. 3 is a side view of the collapsible container shown in FIG. 1 with the shoulder straps in a down position;

DETAILED DESCRIPTION

Figure 4:
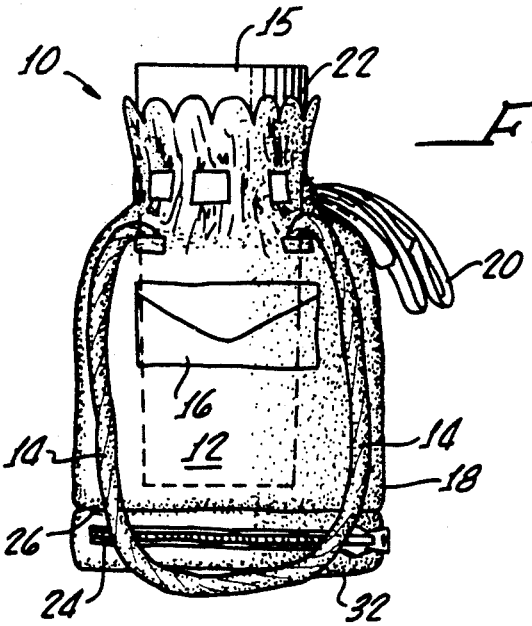
FIG. 4 is the container shown in FIG. 3 with the closable open top shown supporting a relatively tall narrow cup.
Figure 5:
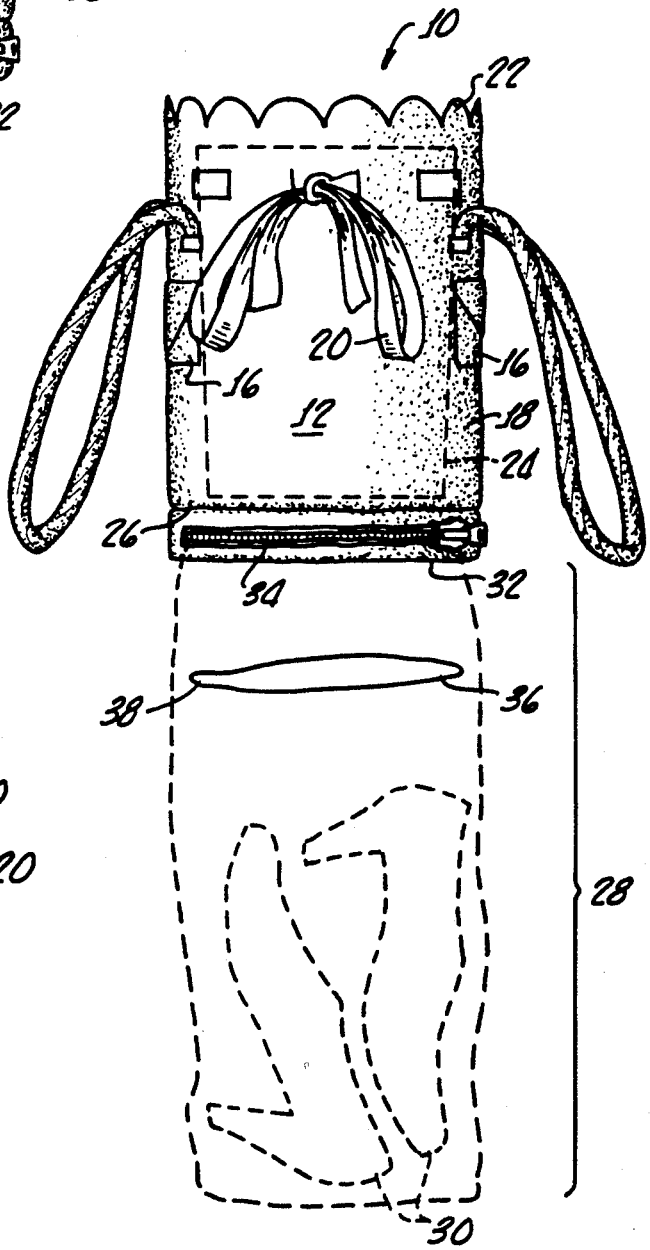
FIG. 5 shows a casino coin cup, slipper and shoe holder, including the collapsible container, along with pocket means disposed on the container bottom for holding a pair of foldable slippers and thereunder a collapsible bag for holding a pair of shoes, the collapsible bag being shown in dotted line in an expanded position and in solid line in a closed position, and the closable open top shown supports a relatively short wide cup.
Figure 6:
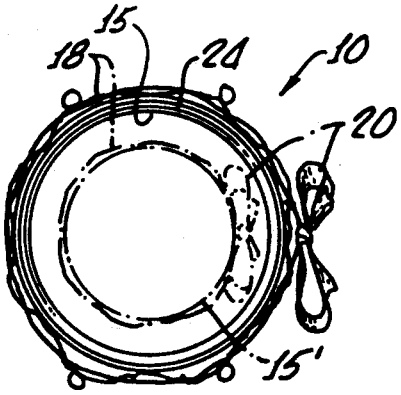
FIG. 6 is a top view of the holder of FIG. 5 showing the accommodations of the present invention for holding cups of different diameters.

Turning now to the figures, a casino cup, slipper and shoe holder 10, in accordance with the present invention, includes a foldable container 12 which may be sewn with any suitable nylon/polyester or lightweight material. The dimensions may be approximately eight (8) inches high by a base width of six (6) inches in diameter. Two adjustable shoulder straps 14 may be provided on each side of the container 12. Two pockets 16 for wet wipes (to clean hands) may be attached to an extension of a body 18 of the container 12. The container 12 is opened and closed by a drawstring cord 20 near the top 22 of the container 12 which also provides means for securing different size cups 15', 15 as will be described hereinafter. The container 12, when not holding the plastic coin cup 15', 15, will fold up easily and fit into a purse or pocket (not shown). The container 12 will hold and secure plastic cups 15', 15 of various sizes through the use of the drawstring cord 20. This is shown in FIGS. 4 to 6 in which the holder 10 is illustrated supporting the relatively tall narrow cup 15 and the relatively short wide cup 14= (dashed lines).

The cup/slipper version of the holder 10 holds the folded hard sole slipper (not shown) in the bottom 26 of the container 12. A folded rolled-up shoe bag 28 drops down and is large enough to hold a pair of shoes 30 (shown in dashed lines). The casino patron can easily switch uncomfortable shoes for comfortable hard sole slippers. This is for persons on the tour buses (feet swell in the heat), patrons at the slot machines with no stools, patrons who want to dress up for dinner and shows early in the evening but want foot comfort while playing the slot machines later in the evening and in the early morning. The folded slippers can be plain and simple to glitzy gold and silver.

The shoulder straps can be used to hang on a door in the ladies room, adding to the patrons' convenience.

The materials to be used to make the casino cup holder/casino cup/slipper holder will be lightweight, strong and colorful. The invention is easily transportable and frees the hands of the patrons when sitting at the slots or walking, or using the restrooms.

A pocket 32 provides another means for storing slippers (not shown) and a zipper 34 provides means for releasably closing the pocket 32.

The collapsible bag 28 is shown in a folded position (solid line) and an expanded position (dotted line) in FIG. 5, the latter position amenable for carrying the shoes 30. An opening 36 provides means for insertion and removal of the shoes 30 which may be covered by a flap 38.

Although there has been hereinabove described specific arrangements of a casino coin cup slipper and shoe holder, in accordance with the invention, for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A casino cup, slippers and shoe holder for use in a gambling establishment having a slot machine, coins for playing said slot machine, and a coin cup for carrying said coins about said gambling establishment, said casino cup, slipper and shoe holder comprising, in combination:

a foldable container means, having a closable open top, a closed bottom and a body for accepting and holding a plastic-type coin cup in a manner enabling access thereto through the closable open top;

means, disposed proximate said closable open top, for releasably closing said closable open top and for securing different size coin cups in the foldable container means, said releasable closing means cooperating with said closable open top such that the opening defined by said closable open top can be constricted about an upper portion of said coin cup when said coin cup is resting on said closed bottom in said foldable container means thereby securing said coin cup in said foldable container means while simultaneously allowing access thereto through said closable open top;

adjustable shoulder strap means, attached to the foldable container body, for carrying the foldable container; and means attached to the foldable container for storing at least one pair of shoes.

2. The casino coin cup, slipper and shoe holder according to claim 1 wherein said means for storing at least one pair of shoes is attached to the foldable container means closed bottom and depends therefrom.

3. The casino coin cup, slipper and shoe holder according to claim 2 wherein said means for storing at least one pair of shoes is configured for storing two pairs of shoes in a spaced apart relationship.

4. The casino coin cup slipper and shoe holder according to claim 3 wherein said means for storing at least one pair of shoes comprises pocket means, attached to the foldable container means closed bottom, for storing a pair of foldable slippers, said pocket means including means for releasably closing said pocket means.

5. The casino coin cup slipper and shoe holder according to claim 4 wherein said means for storing at least one pair of shoes further comprises collapsible bag means, attached to said pocket means, for carrying a pair of shoes when said collapsible bag means is expanded, said collapsible bag means including means, defining an opening therein, for enabling insertion and removal of the pair of shoes.

6. The casino coin cup, slipper and shoe holder according to claim 5 wherein said foldable container ;means body has a diameter of at most about six inches.

7. The casino coin cup, slipper and shoe holder according to claim 6 further comprising side pocket means, attached to an exterior of the foldable container means body, for storing cleaning accessories.

8. A casino coin cup, slipper and shoe holder for use in gambling establishment having a slot machine, coins for playing said slot machine, and a coin cup for carrying said coins about said gambling establishment, said casino coin cup, slipper and shoe holder comprising, in combination:

foldable container means, having a closable open top, a closed bottom and a body for accepting and holding a plastic-type coin cup in a manner enabling access thereto through the closable open top, said body having a diameter of at most about six inches;

drawstring means, disposed proximate said closable open top, for releasably closing said closable open top and for securing different size cups in the foldable container means, said drawstring means cooperating with said closable open top such that the opening defined by said closable open top can be constricted about an upper portion of said coin cup when said coin cup is resting on said closed bottom in said foldable container means thereby securing said coin cup in said foldable container means while simultaneously allowing access thereto through said closable open top;

adjustable shoulder strap means, attached to the foldable container body, for carrying the foldable container;

pocket means, attached to the foldable container bottom, for storing a pair of foldable slippers, said pocket means including zipper means for releasably closing said pocket means; and collapsible bag means, attached to said pocket means, for storing a pair of shoes when said collapsible bag means is expanded, said collapsible bag means including means, defining a flap covered opening therein, for enabling insertion and removal of the pair of shoes.

* * * * *